US005655901A

United States Patent [19]

Makoto

[11] Patent Number: 5,655,901

[45] Date of Patent: Aug. 12, 1997

[54] LIGHTER WITH SAFETY DEVICE

[75] Inventor: Ichikawa Makoto, Tokyo, Japan

[73] Assignee: Modern Royal Co. Ltd., Tokyo, Japan

[21] Appl. No.: 506,646

[22] Filed: Jul. 25, 1995

[30] Foreign Application Priority Data

Mar. 23, 1995 [KR] Rep. of Korea ..... 95-5249

[51] Int. Cl.[6] ..... F23D 11/36

[52] U.S. Cl. ..... 431/153; 431/255

[58] Field of Search ..... 431/255, 277, 431/153

[56] References Cited

U.S. PATENT DOCUMENTS

| | | | |
|---|---|---|---|
| 4,784,602 | 11/1988 | Nitta | 431/153 |
| 4,786,248 | 11/1988 | Nitta | 431/255 |
| 4,799,877 | 1/1989 | Bisbee | 431/153 |
| 4,830,603 | 5/1989 | Cirami | 431/153 |
| 4,832,596 | 5/1989 | Morris, Sr. | 431/153 |
| 4,859,172 | 8/1989 | Nitta | 431/153 |
| 4,904,180 | 2/1990 | Nitta | 431/153 |
| 4,921,420 | 5/1990 | Johnston | 431/153 |
| 5,074,781 | 12/1991 | Fujita | 431/277 |
| 5,076,783 | 12/1991 | Fremund | 431/153 |
| 5,085,578 | 2/1992 | Hunter | 431/277 |
| 5,090,893 | 2/1992 | Floriot | 431/153 |
| 5,092,764 | 3/1992 | McDonough et al. | 431/277 |
| 5,120,215 | 6/1992 | Amoros Nollas | 431/153 |
| 5,125,829 | 6/1992 | McDonough et al. | 431/255 |
| 5,145,358 | 9/1992 | Shike et al. | 431/153 |
| 5,165,886 | 11/1992 | Frigiere | 431/254 |
| 5,171,143 | 12/1992 | Sohn | 431/153 |
| 5,205,729 | 4/1993 | Iwahori | 431/153 |
| 5,213,493 | 5/1993 | Iwahori | 431/153 |
| 5,215,458 | 6/1993 | Cirami | 431/277 |
| 5,240,408 | 8/1993 | Kenjiro et al. | 431/277 |
| 5,288,226 | 2/1994 | Khemarangsan | 431/277 |
| 5,409,372 | 4/1995 | Noburo | 431/153 |

FOREIGN PATENT DOCUMENTS

| | | | |
|---|---|---|---|
| 0291956 | 11/1988 | European Pat. Off. | 431/153 |

*Primary Examiner*—Carl D. Price

*Attorney, Agent, or Firm*—Michael D. Bednarek; Kilpatrick Stockton LLP

[57] ABSTRACT

A portable lighter, or particularly a lighter with a safety device is disclosed, in which safety is ensured by using a separate locking device. While a lighter is convenient, the conventional lighter broods the danger that, if it is accidentally lighted, or if a child plays with it, a hellish catastrophe can occur. The present invention is intended to overcome the above described disadvantages of the conventional technique. Therefore it is the object of the present invention to provide a lighter with a safety device, in which the lighter is locked after each use, so that unexpected disaster can be prevented. In achieving the above object, the lighter according to the present invention is characterized in that a pressing button for activating a piezo electric device is prevented from being activated by a locking section, the locking section being for temporarily locking an igniting section. The locking section is activated by the pressing button and a locking member. At the rear of the pressing button, there are formed a sliding slot and an engagement step. The locking member which is related to the sliding slot and the engagement step is provided with a sliding piece and an elastic piece. The locking member includes an inner plate and an outer plate, and the inner plate includes a sliding piece and an elastic piece in an integral form, while the outer plate is exposed to the outside of the lighter, thereby forming a handle.

14 Claims, 4 Drawing Sheets

LIGHTER WITH SAFETY DEVICE

FIELD OF THE INVENTION

The present invention relates to a portable lighter, and particularly to a lighter with a safety device, in which safety is ensured by using a separate locking device.

DESCRIPTION OF THE PRIOR ART

Lighters are widely used as igniting devices, and are provided in various shapes so as to give convenience. Particularly, lighters are indispensable means to habitual smokers.

In such lighters which are widely used, an inflammable gas is mostly used.

The igniting device of a lighter is based on frictions between metals, or a piezo electric device which discharges a momentary electric current following a momentary impact so as to ignite the gas. These two methods are the generally used ones.

In such a lighter, the igniting device is activated, and at the same time, a gas spouting nozzle is opened, so that a flame can be maintained.

While a lighter is convenient, it broods the danger that, if it is accidentally lighted, or if a child plays with it, a hellish catastrophe can occur.

SUMMARY OF THE INVENTION

The present invention is intended to overcome the above described disadvantages of the conventional technique.

Therefore it is the object of the present invention to provide a lighter with a safety device, in which the lighter is locked after each use, so that unexpected disaster can be prevented.

In achieving the above object, the lighter according to the present invention is characterized in that a pressing button for activating a piezo electric device is prevented from being activated by a locking section, the locking section being for temporarily locking an igniting section.

The locking section is activated by the pressing button and a locking member.

At the rear of the pressing button, there is formed a sliding slot and an engagement step. The locking member which is related to the sliding slot and the engagement step is provided with a sliding piece and an elastic piece.

The locking member includes an inner plate and an outer plate, and the inner plate includes a sliding piece and an elastic piece in an integral form, while the outer plate is exposed to the outside of the lighter, thereby forming a handle.

BRIEF DESCRIPTION OF THE DRAWINGS

The above object and other advantages of the present invention will become more apparent by describing in detail the preferred embodiment of the present invention with reference to the attached drawings in which:

FIG. 4 illustrates the operating states of the lighter according to the present invention, in which:

DESCRIPTION OF THE PREFERRED EMBODIMENT

Figure 1:
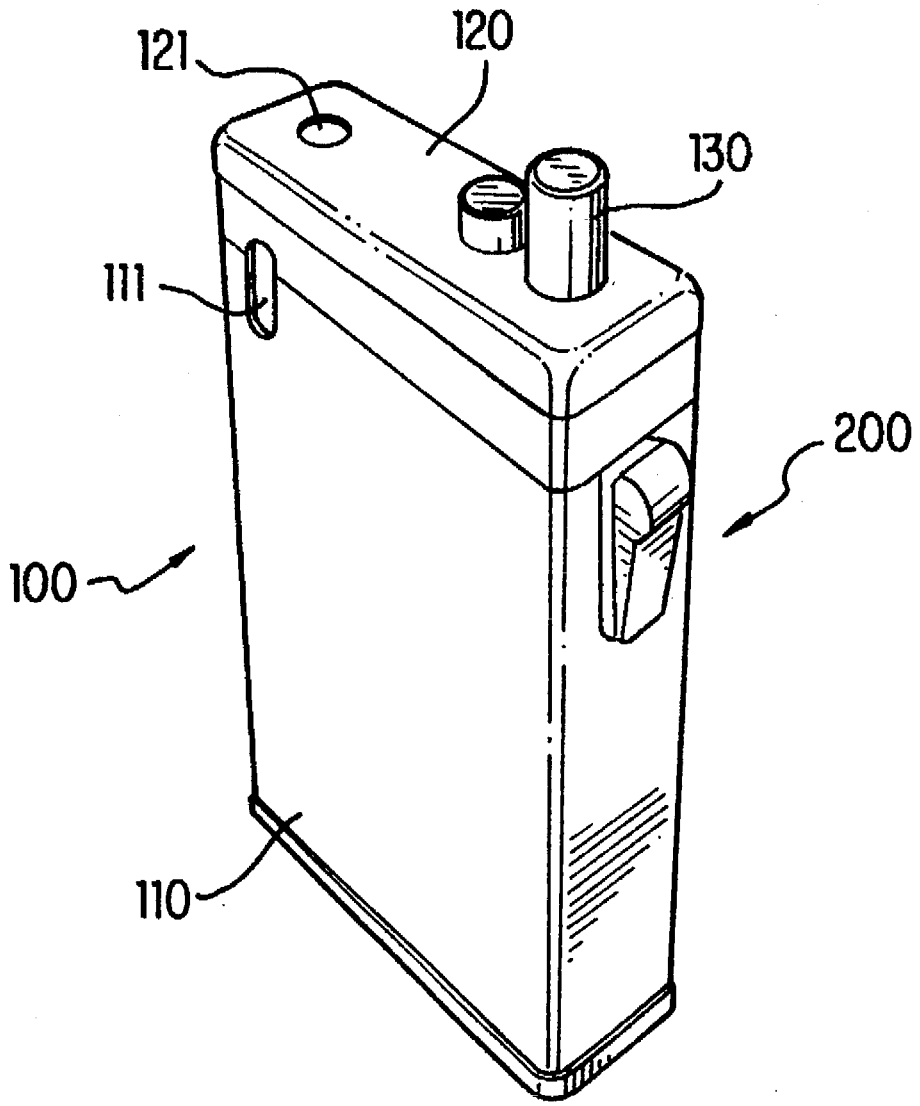
FIG. 1 is a perspective view of the lighter according to the present invention.
Figure 2:
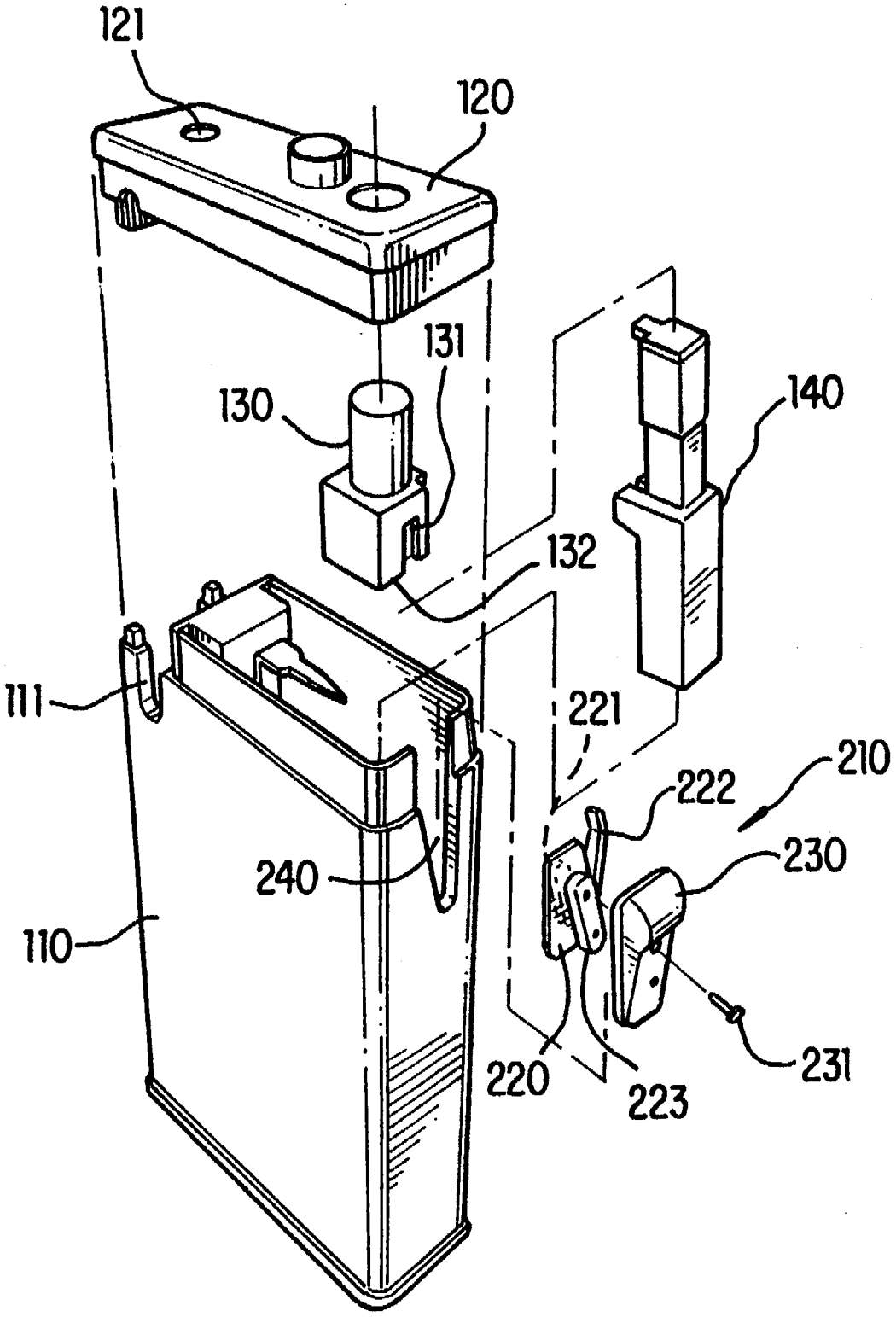
FIG. 2 is an exploded perspective view of the critical portions of the lighter according to the present invention.
Figure 3:
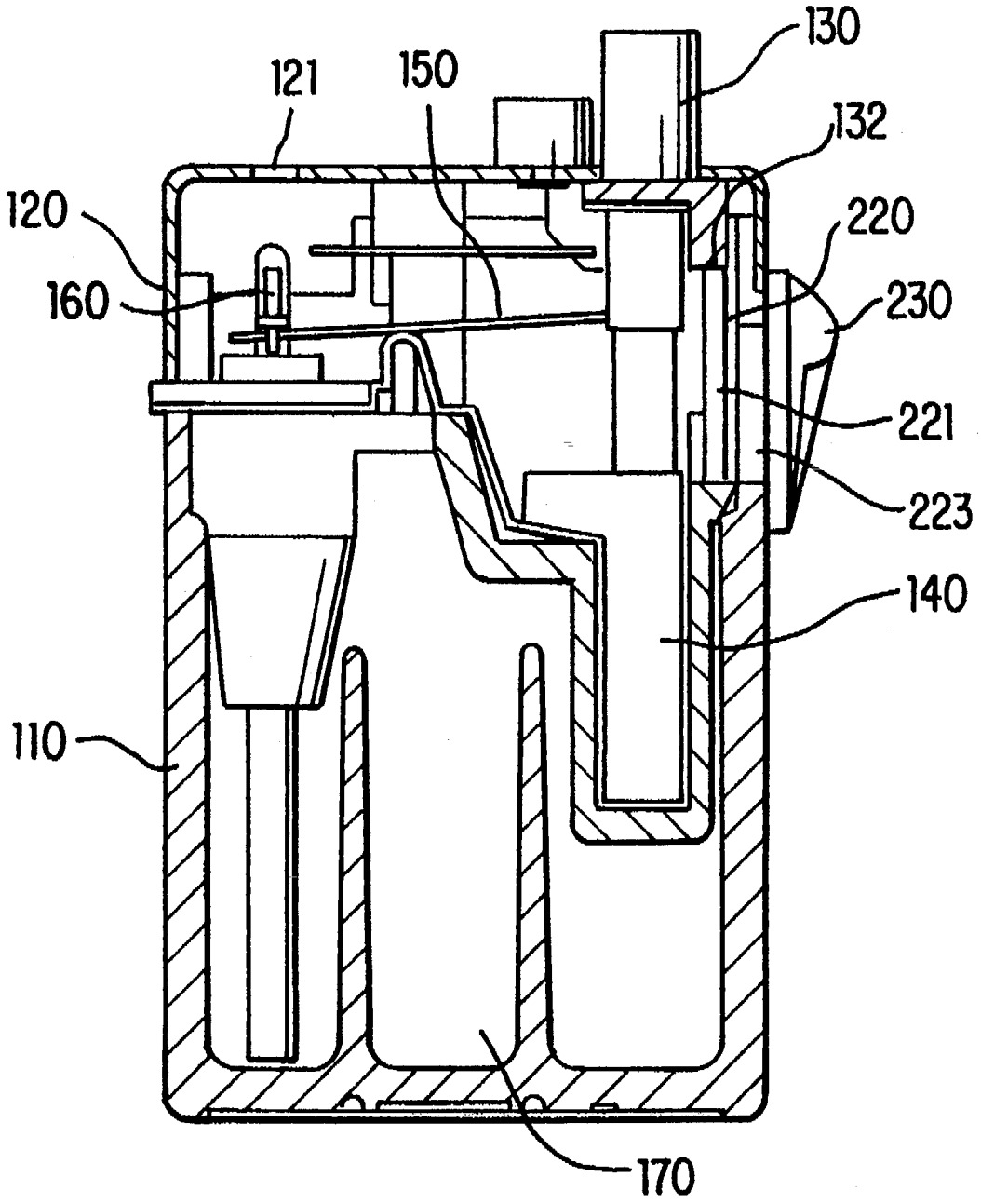
FIG. 3 is a sectional view showing the internal constitution of the lighter according to the present invention.

FIG. 1 is a perspective view of the assembled lighter according to the present invention, and the lighter 100 is provided with a locking section 200 which ensures the safety of the lighter 100.

On the top of a main body 110 of the lighter, there is fitted a lid 120 in which a flame discharge hole 121 is formed. Below the flame discharge hole 121, there is formed an air inlet 111.

The lighter 100 according to the present invention includes: a gas spouting section for uniformly spouting the gas from a gas tank 170, the gas tank 170 being formed within the main body 110 of the lighter 100; an igniting section for igniting the gas and for activating the gas spouting device; and a locking section for controlling the operation of the igniting section.

The gas spouting section includes a nozzle 160 for spouting the gas and for blocking the gas; and a lever 150 for activating the nozzle 160 upon activating the igniting section.

The igniting section includes: a known piezo electric device 140; and a pressing button 130 for imposing an impact on the piezo electric device so as to release an electric current.

The pressing button 130 activates the lever 150, and a current flows from the piezo electric device 140 through the lever 150 to near the nozzle 160, so that an arc discharge would occur.

At the rear of the pressing button 130, there are formed a sliding slot 131 and an engaging step 132.

The sliding slot 131 and the engaging step 132 are provided in such a manner that they should be interacted with a sliding piece 221 of a locking member 210 of the locking section.

The locking member 210 is inserted into an actuation slot 240 which is formed on the main body 110, and the locking member 210 is provided with an inner plate 220 and an outer plate 230.

That is, the inner plate 220 and the outer plate 230 are coupled together with a certain gap left between them by using a guide piece 223, and this assembly is inserted into the actuation slot 240.

On the inner side of the inner plate 220, there is attached a vertically elongated sliding piece 221, while an elastic piece 222 is attached on a side of the inner plate 220 to exert an elastic force.

The inner plate 220 and the outer plate 230 of the locking member 210 are coupled together by means of bolts 231. Or alternatively, concave and convex forms are formed to couple them together, or an adhesive is used to couple them together.

If the sliding piece 221 of the locking member 210 is engaged with the engaging step 132 of the pressing button 130, then the lighter is locked. On the other hand, if the sliding piece 221 is inserted into the sliding slot 131, the lighter can be operated.

The outer plate 230 serves as a handle for the locking section.

The locking member 210 is inserted into the main body 110 when assembled, and is elastically biased in one direction by the elastic piece 222 all the time.

That is, the locking member 210 is elastically biased, so that it can be engaged with the engaging step 132 of the pressing button 130.

The actuation slot 240 which is formed in the main body 110 is shaped like an inverted trapezoid, so that the locking member can be inclined by a certain angle.

The lighter of the present invention constituted as above will now be described as to its operations.

The lighter of the present invention can be operated only after releasing the locking section.

That is, only after releasing the engaged state between the locking member 210 and the pressing button 130, can the pressing button 130 can be pushed down.

FIG. 4 illustrates the operating states of the lighter according to the present invention, in which: FIG. 4A illustrates a locked state; FIG. 4B illustrates a state with the locking member swung; FIG. 4C illustrates a state with the lock released; and FIG. 4D illustrates a state with the igniting section activated.

If the lighter is to be operated, first the locking member 210 is released before pressing the pressing button 130.

Figure 4A:
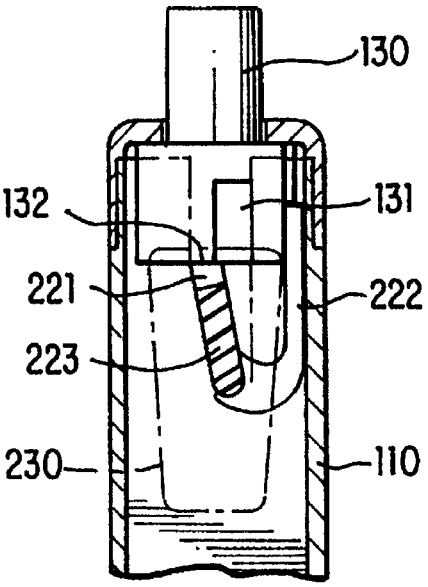
FIG. 4A illustrates a locked state.
Figure 4B:
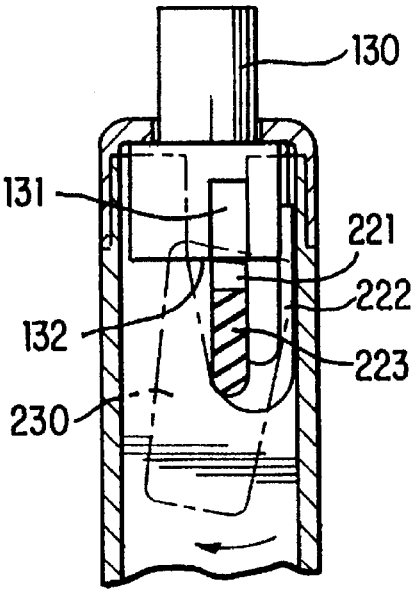
FIG. 4B illustrates a state with the locking member swung.
Figure 4C:
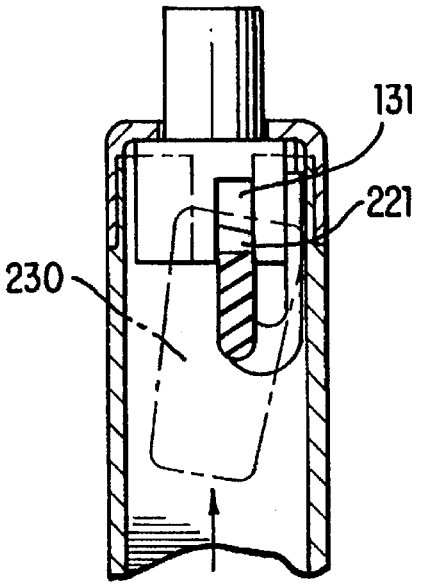
FIG. 4C illustrates a state with the locking released.

In order to release the locking member 210, the outer plate 230 is turned as shown in FIG. 4B, and then, it is lifted, so that the locked state would be released as shown in FIG. 4C.

In the lock released state, the sliding piece 221 is inserted into the sliding slot 131 of the pressing button 130.

Figure 4D:
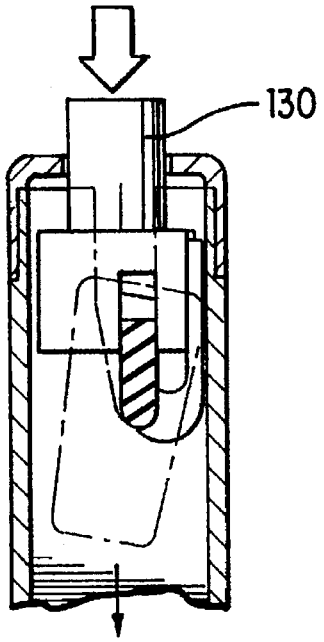
FIG. 4D illustrates a state with the igniting section activated.

In this lock released state, if the pressing button is pressed, the lighter is operated as shown in FIG. 4D.

That is, by pressing the pressing button 130, the lever 150 of the gas spouting section is activated, and at the same time, the nozzle 160 is opened, thereby spouting the gas.

At the same time, the piezo electric device 140 is activated to supply a momentary electric current, thereby igniting the gas.

Under this condition, the locking member 210 descends together with the pressing button 130, receives an elastic force in one direction from the elastic piece 222.

After use of the lighter, if the pressing button 130 is released, the nozzle 160 stops the spouting of the gas owing to the nozzle spring, and at the same time, the pressing button 130 is restored to the original position owing to a spring which is installed within the piezo electric device 140.

Thus the pressing button 130 is elevated, but the locking member 210 is maintained at a stationary position due to the elastic piece 222 which is closely contacted with the main body 110.

Accordingly, the sliding piece 221 of the locking member 210, which has been inserted into the sliding slot 131 of the pressing button 130 departs from the sliding slot 131. Finally, the locking member 210 is pivoted by the elastic force of the elastic piece 222, and the leading end of the sliding piece 221 is engaged with the engaging step 132 of the pressing button 130, thereby realizing a locked state.

In this locked state, the pressing button 130 cannot be pushed down, and if the lighter is to be used again, the locking member 210 has to be shifted to a released state.

According to the present invention as described above, a locking device is provided, so that the lighter cannot be used repeatedly and continuously. Consequently, an accidental firing can be prevented so as to avoid an unexpected disaster.

What is claimed is:

1. A lighter with a safety device, comprising:

a main body having an interior including a gas tank and an exterior;

a nozzle for spouting a gas from said gas tank;

means for causing the gas to spout from said nozzle;

means for igniting the gas spouting from the nozzle, including a piezoelectric device and a pressing button for actuating said piezoelectric device so as to cause a spark by electrical arcing; and a rotatable locking member for disabling said means for igniting, said locking member being biased towards a locking position where said locking member prevents actuation of said pressing button, unless said rotatable switch is rotated away from said locking position before said pressing button is actuated, wherein said main body includes a tapered slot in which said locking member is accommodated so as to be limitedly rotatable.

2. The lighter with a safety device as claimed in claim 16, wherein said pressing button is provided with a sliding slot for admitting a portion of said locking member, thereby permitting actuation of said pressing button, and an engaging step for abutting said portion of said locking member and thereby preventing actuation of said pressing button, depending on a rotational position of said locking member.

3. The lighter with a safety device as claimed in claim 2, wherein said locking member comprises:

an inner plate provided on an interior face of said main body, said inner plate being provided with a locking portion thereon;

an elastic member constructed and arranged to bias said locking member towards said locking position; and an exterior switch secured to said inner plate.

4. The lighter with a safety device as claimed in claim 3, wherein said exterior switch is rotatable by a certain angle to release an abutment between said locking portion and said engaging step of said pressing button, thereby allowing said locking portion provided on said inner plate to slide into said sliding slot of said pressing button.

5. The lighter with a safety device as claimed in claim 3, wherein said inner plate and said exterior switch are secured together with bolts.

6. The lighter with a safety device as claimed in claim 3, wherein said inner plate and said exterior switch each have concave and convex contours that interfit so as to secure together said inner plate and said exterior switch.

7. The lighter with a safety device as claimed in claim 3, wherein said inner plate and said exterior switch are adhesively secured together.

8. The lighter with a safety device as claimed in claim 1, wherein said tapered slot in said main body narrows toward the a bottom of said main body.

9. A lighter with a safety device as claimed in claim 1, wherein said exterior switch must be rotated and pushed upward, relative to said main body, to permit actuation of said pressing button.

10. The lighter with a safety device as claimed in claim 3, wherein said tapered slot in said main body is a switch slot for accommodating movement of said exterior switch, said exterior switch substantially covering said switch slot, wherein said sliding slot is located in an interior of said pressing button.

11. A lighter with a safety device, comprising:

a main body having a gas tank in an interior thereof;

a gas spouting section for spouting a gas from the gas tank;

a piezo electric device disposed in said main body for igniting the spouting gas, said main body including a slot formed in one side of an upper portion thereof;

a pressing button provided on an upper surface of said main body for actuating said piezo electric device, said pressing button being provided at a lower portion thereof with a sliding slot and an engaging step; and a locking device including an outer plate, an inner plate, a guide piece interposed between and connecting said outer plate and said inner plate, a sliding piece attached to a surface of said inner plate, and an elastic piece attached to a side surface of said inner plate, said guide piece being fitted in said slot in said main body, said locking device being biased by a biasing force of said elastic piece resiliently contacting a surface of said slot, said sliding piece being in engagement at an upper end thereof with said engaging step of said pressing button while said locking device is in a biased position, thereby preventing said pressing button from being depressed;

wherein said outer plate is manually moveable such that said guide piece is moved to an opposite side of said slot, against the biasing force of said elastic piece, thereby moving the upper end of said sliding piece opposite a lower end of said sliding slot, thereby permitting said pressing button to be depressed such that said sliding piece passes into said sliding slot.

12. The lighter with a safety device as claimed in claim 11 wherein said slot in said main body is tapered so as to narrow toward a bottom of said main body.

13. The lighter with a safety device as claimed in claim 11, wherein said sliding piece is attached at an angle to a surface of said inner plate and becomes perpendicular to a lower surface of said pressing button when said upper end of said sliding piece is moved to face a lower end of said sliding slot.

14. The lighter with a safety device as claimed in claim 11, wherein said outer plate is flat and has a size sufficient to cover said slot provided in said main body.

* * * * *